US006648084B2

(12) United States Patent
Morey et al.

(10) Patent No.: US 6,648,084 B2
(45) Date of Patent: Nov. 18, 2003

(54) HEAD FOR INJECTING LIQUID UNDER PRESSURE TO EXCAVATE THE GROUND

(75) Inventors: Jacques Morey, Nanterre (FR); Jean-Claude Gessay, Nanterre (FR)

(73) Assignee: Compagnie du Sol, Nanterre (FR)

( * ) Notice: Subject to any disclaimer, the term of this patent is extended or adjusted under 35 U.S.C. 154(b) by 12 days.

(21) Appl. No.: 10/071,480

(22) Filed: Feb. 7, 2002

(65) Prior Publication Data

US 2002/0108752 A1 Aug. 15, 2002

(30) Foreign Application Priority Data

Feb. 12, 2001 (FR) ..... 01 01856

(51) Int. Cl.[7] ..... E21B 7/18; E21B 41/00
(52) U.S. Cl. ..... 175/67; 175/71; 175/424
(58) Field of Search ..... 166/222; 175/67, 175/71, 340, 393, 424

(56) References Cited

U.S. PATENT DOCUMENTS 4,624,606 A 11/1986 Nakanishi et al. ..... 405/269
5,228,809 A * 7/1993 Yoshida et al. ..... 405/269

FOREIGN PATENT DOCUMENTS

JP 61053912 3/1986 ..... E02D/3/12
JP 09025626 1/1997 ..... E02D/3/12
JP 10195862 7/1998 ..... E02D/3/12

OTHER PUBLICATIONS

Fremch Search Report dated Sep. 25, 2001.

* cited by examiner

*Primary Examiner*—David Bagnell
*Assistant Examiner*—Brian Halford
(74) *Attorney, Agent, or Firm*—Cohen, Pontani, Lieberman & Pavane

(57) ABSTRACT

The invention provides a head for injecting a liquid under pressure from a borehole to break up the soil, said head being mounted at the end of a drill string including a liquid feed for feeding a liquid under pressure. The head comprises a body and an outside wall, the body having at least one injection nozzle mounted therein, the nozzle having an inlet diameter equal to d and presenting an axis (x–x'), the body also having a tube. The tube presents a mean line having a first end connected to the bottom end of the liquid feed and having a second end connected to the nozzle tangentially to the axis (x–x'). The mean line is defined by at least one curved portion presenting a radius of curvature that varies continuously. The right section of the tube decreases regularly over at least half of its length from its first end to its second end.

10 Claims, 2 Drawing Sheets

HEAD FOR INJECTING LIQUID UNDER PRESSURE TO EXCAVATE THE GROUND

The present invention relates to a head for injecting liquid under pressure to excavate the ground, and in particular it relates to an injection head for implementing the technique known as "jet grouting".

BACKGROUND OF THE INVENTION

The jet grouting technique consists in breaking up the soil by means of a jet of liquid having very high kinetic energy that is implemented in a borehole, the liquid jet serving to erode the ground in which excavation is to be performed. To form the jet, a nozzle is used which is fixed to the end of a drill string, the rods of the drill string serving simultaneously to convey liquid under high pressure to the nozzle(s) and to move the nozzle progressively in translation in the soil. More precisely, the nozzle(s) is/are mounted on a member usually referred to as a "monitor" or as an "injection head", which member is fixed to the bottom end of the drill string, said monitor itself optionally being fitted at its bottom end with a mechanical boring tool. As is known, the liquid generally used is a cement-based slurry which serves, after boring, to make a cement element in the ground that is molded in place in the soil.

The liquid which is conveyed by the drill string is delivered from the surface by means of a pump at a pressure of one to several tens of megapascals (MPa). The inside diameter of the drill string conveying the liquid must be large enough to minimize head losses in the string. This diameter can typically be of the order of 20 millimeters (mm) to 50 mm. In contrast, the outlet diameter from the nozzle must be small enough to impart sufficient speed to the jet of liquid that leaves the nozzle for it to erode the soil remotely. Typically, the outlet diameter of the nozzle lies in the range 2 mm to 5 mm as a general rule, and the outlet speed of the liquid from the nozzle lies in the range one to several hundreds of meters per second (m/s).

To obtain a jet of high quality, it is desirable for the inside shape of the nozzle to be optimized so as to conserve as high a speed as possible for the liquid jet as it moves away from the nozzle towards the soil so as to enable it to erode the soil as much as possible while using a minimum amount of kinetic energy. Optimized nozzle shapes satisfying this requirement are in widespread use.

However, even with such nozzles, it is found that the jet quickly loses effectiveness in eroding the soil, such that considerable levels of kinetic energy are necessary so that when the drill string is moved in translation and optionally in rotation, the soil is eroded at a considerable distance away from the nozzle, e.g. at a distance of several decimeters (dm). The active radius of the jet of liquid under pressure for forming a column, a sector of a column, or a plane element generally remains poor, lying in the range a few decimeters to 1 meter (m) or 2 m depending on the method implemented, on the nature of the soil, and on the energy deployed.

To increase the action of the jet, proposals have been made, in particular in U.S. Pat. No. 5,228,809, to implement the injection head or monitor in such a manner as to improve the quality of the jet.

Accompanying FIG. 1 shows the injection head described in that patent. The injection head 10 comprises a body 12 having a side wall 14 which defines an inside cavity. A nozzle 16 for injecting liquid under pressure is mounted in the outside wall 14 of the monitor. In this figure, there can also be seen elements 18 for connection with the drill string and elements 20 and 22 for connection with the pressurized liquid pipe and with an annular air pipe that runs along the drill string so as to make it possible simultaneously to feed the nozzle with liquid and to feed an annular nozzle with air. According to that patent, the nozzle 16 is fed from the pipe 22 for feeding liquid under pressure via a passage 24 made in the body of the monitor 10 and via a tube 26 connecting the end of said passage to the inlet of the nozzle 16. The tube 26 is of constant section and of regular curvature so as to limit the disturbance it imparts to the liquid under pressure between the drill string and the nozzle 16 itself. Nevertheless, as explained, the diameter of the injection nozzle is very small compared with the diameter of the pipe that feeds liquid under pressure along the drill string. The solution described in the above-mentioned American patent is therefore not entirely satisfactory.

OBJECTS AND SUMMARY OF THE INVENTION

An object of the present invention is to provide an injection head, in particular for performing jet grouting, which makes it possible to further improve the quality of the jet delivered by the nozzle(s) of the injection head mounted at the bottom end of the drill string.

According to the invention, this object is achieved by a head for injecting liquid under pressure from a borehole to break up soil, said head being mounted at the end of a drill string, said string including liquid feed means for feeding liquid under pressure, said head comprising:

- a body having an outside wall and a top end for connection to the bottom end of the drill string;
- at least one injection nozzle mounted in said body, the inlet diameter of said nozzle being equal to d, said nozzle possessing an axis x,x'; and
- duct-forming means for connecting the feed of liquid to the inlet of said nozzle, said duct-forming means presenting a mean line having a first end connected to the bottom end of said liquid feed means and having a second end connected to the nozzle tangentially to said axis x,x', said mean line being defined by at least one curved portion presenting a radius of curvature that varies continuously, the right section of said duct-forming means decreasing regularly over at least half of its length from its first end to its second end.

It will be understood that the quality and the direction of the jet produced by the nozzle are substantially improved because the right section of the duct-forming means, e.g. a tube, decreases progressively and regularly, over at least half of its length from its end for connection to the pipe for feeding liquid under pressure to its connection to the inlet orifice of the injection nozzle. This characteristic combined with the fact that the mean line of the duct-forming means presents a radius of curvature which varies regularly makes it possible to minimize disturbances to the flow of liquid in said tube and thus to obtain a jet at maximum energy with erosive power that is maintained to a maximum distance away from the nozzle into the soil.

In a first embodiment, the axis of the liquid feed means coincides substantially with the axis of said body of the injection head, and the mean line of the duct-forming means comprises a first curved portion extending between said first end and an intermediate point and presenting regular curvature whose concavity presents a first sign, and a second curved portion extending between said intermediate point and said second end, and presenting regular curvature whose concavity presents an opposite sign.

It will be understood that because of the particular configuration of the duct-forming means, e.g. the tube, with its two curved portions, it is possible for given outside diameter of the injection head to increase the length of the tube and to increase the length of the tube portion that has a large radius of curvature connected directly to the nozzle.

In a second embodiment, the pipe for feeding under pressure extends into said injection head and the first end of the duct-forming means is a lateral branch on said pipe that is substantially tangential to said pipe.

BRIEF DESCRIPTION OF THE DRAWINGS

Other characteristics and advantages of the invention will appear more clearly on reading the following description of various embodiments of the invention given as non-limiting examples. The description refers to the accompanying figures, in which.

MORE DETAILED DESCRIPTION

Figure 1:
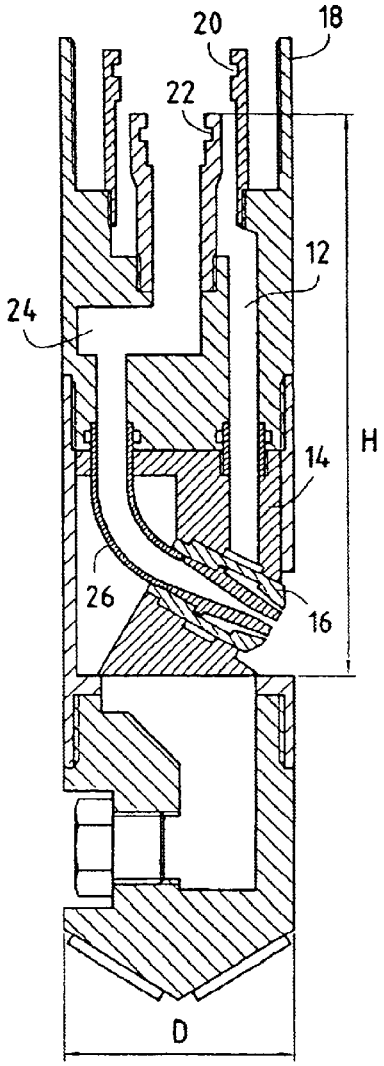
FIG.1 PRIOR ART
FIG. 1, described above, is a vertical section view through a known injection head.
Figure 2:
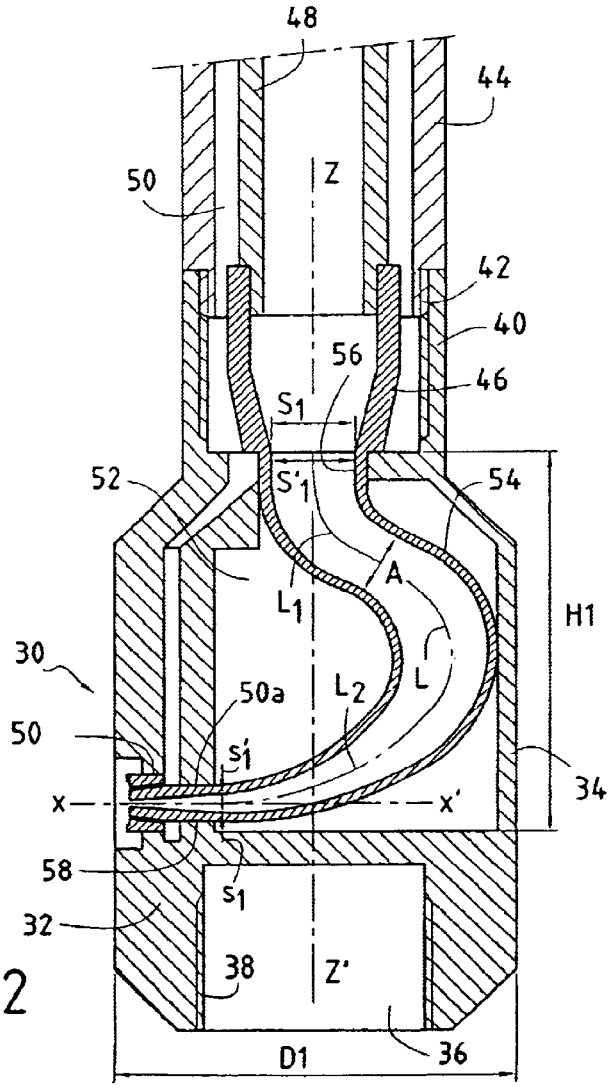
FIG. 2 is a vertical section view through a first embodiment of an injection head or monitor of the invention.

The injection head 30 shown in FIG. 2 comprises a body 32 constituted by a cylindrical side wall 34, a bottom end 36 including means, e.g. a thread 38, for securing a mechanical boring tool, and a top end 40. The top end 40 carries both a thread 42 for connection to the bottom end of a drill string 44 and an inside sleeve 46 for connection to the pipe 48 provided inside the drill string 44 for conveying pressurized liquid which is generally constituted by a slurry, as mentioned above. In the particular embodiment described, the annular space 50 between the drill string 44 and the pipe 48 is used to convey air under pressure. Naturally, in certain embodiments, it is possible to omit this annular space.

Figure 4:
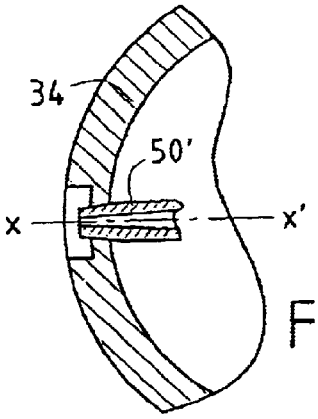
FIGS. 4 and 5 are fragmentary horizontal section views showing two possible ways in which liquid injection nozzles can be implanted.
Figure 5:
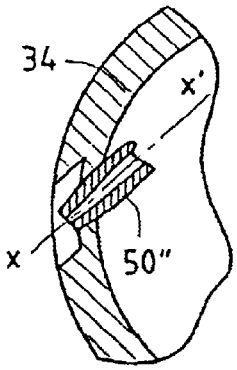

Above its bottom end 36, the side wall 34 of the injection head is provided with an injection nozzle 50 on axis x,x'. In the embodiment described, the axis x,x' of the nozzle 50 is substantially perpendicular to the vertical axis z,z', of the injection head, however in other embodiments, this axis could be at an angle relative to the horizontal lying in the range +15° to −15°, for example. In addition, as shown in FIGS. 4 and 5, in horizontal projection, the nozzle can be perpendicular to the outside wall of the monitor (nozzle 50' in FIG. 4) or it can be substantially tangential thereto (nozzle 50" in FIG. 5), or indeed its axis xx' can occupy any intermediate orientation. Inside the cavity 52 of the injection head body, there is mounted a tube 54 serving to connect the feed 46 of liquid under pressure to the inlet 50 of the nozzle 50. The right section of the pipe 46 for feeding liquid under pressure is written S1 and the right section at the inlet of the nozzle 50 is written s1. The tube 54 having a mean line referenced L has a first end 56 for connection to the pipe 46 and a second end 58 for connection to the nozzle. The first end 56 of the tube 54 has a right section S'1 equal to the section S1, and its second end presents a right section s'1 equal to the section s1 of the nozzle. In addition, the right section of the tube 54, i.e. the section of said tube in planes orthogonal to its mean line L, decreases regularly from the value S'l to the value s'1. In some cases, the tube 54 could also include very short portions that are cylindrical.

The right section of the tube can be circular, however its shape could also be oval, elliptical, etc. The terminal sections 56 and 58 are generally circular, however they too could be elliptical. The mean line L of the tube 54 presents curvature that is not constant but that varies regularly. In the embodiment shown in FIG. 2, the mean line L of the tube 54 comprises a first portion $L_1$ going from the end 56 to an intermediate point A, and a second portion $L_2$ which goes from the intermediate point A to the second end 58. The radius of curvature of the portion $L_1$ keeps the same sign, and the same is true for the portion $L_2$, however the sign of this last radius of curvature is opposite that of the portion $L_1$. In other words, the portions $L_1$ and $L_2$ meet tangentially at the point A, where the mean line L presents a point of inflection.

This embodiment makes it possible in particular by means of the portion $L_2$ of the mean line, and thus the corresponding portion of the tube, to increase the length of the portion of tube that presents a large radius of curvature in its zone where it connects with the nozzle. This disposition makes it possible to further stabilize the flow of liquid under pressure in the tube 54 in the vicinity of the nozzle 50.

Naturally, the tube 54 could have some other shape providing its mean line presents variations in curvature that are regular while its right section decreases substantially regularly from its first end 56 to its second end 58 where it is connected to the nozzle. The tube need present only one radius of curvature and it could equally well not have a mean line lying in a plane, instead it could be in the form of a helix or a spiral, i.e. it could be a three-dimensional curve.

It is also clear that it would not go beyond the invention for the injection head to have a plurality of nozzles, and that such an injection head would then have a plurality of tubes similar to the tube 54 and each connected to a pipe for feeding liquid under pressure and contained within the drill string.

It should also be observed that because of the shape of the tube 54 shown in FIG. 2, it is possible to increase the total length of the mean line L of this tube while keeping the outside dimensions of the working portion of the injection head to within the small values corresponding to the diameter $D_1$ and the height $H_1$. Increasing the length of the tube 54 makes it possible for its right section to decrease more progressively for given right sections at the two ends of the tube. In the embodiment described, the diameter $D_1$ is less than 15 centimeters (cm) and the working height of the injection head $H_1$ is less than 50 cm.

Figure 3:
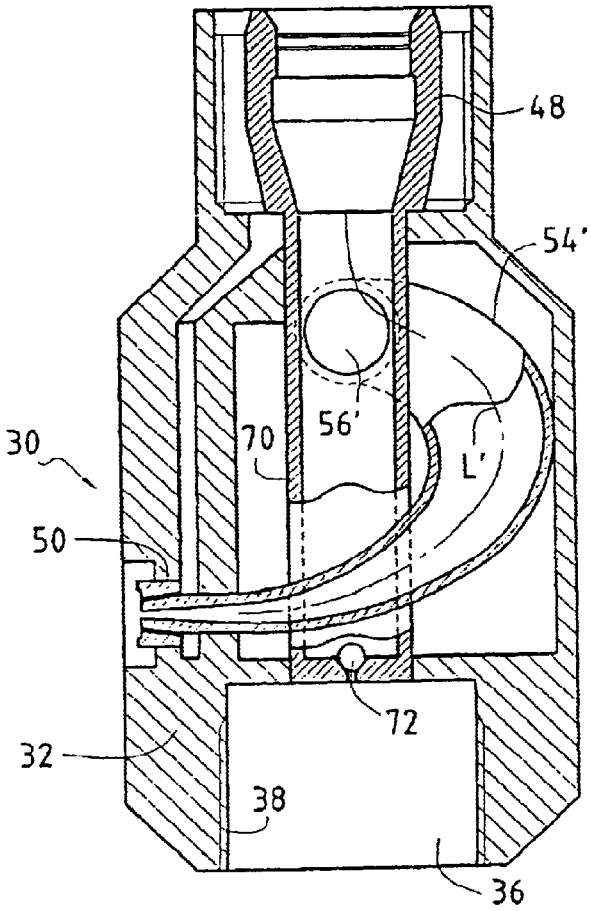
FIG. 3 is a vertical section view through a second embodiment of the injection head.

FIG. 3 shows a second embodiment of a monitor in accordance with the invention. This monitor differs essentially by the fact that its pipe 48 for feeding liquid under pressure is extended into the monitor by a pipe 70 for feeding a mechanical tool which can be fixed in the tapped sleeve 38. When mounted, the tool is fed by the pipe 70 via a controllable valve 72. Under such circumstances, the first end 56' of the tube 54' is a side branch on the pipe 70. This branch is preferably substantially tangential to the wall of the pipe 70.

It will be understood that in the embodiment described above, the mean line L' of the tube 54' is a three-dimensional curve. The tube 54' "wraps" around the pipe 70 so as to go from the branch 56' to the inlet of the nozzle 50.

In the above description, the tube 54 is a separate piece of pipe mounted inside the body of the injection head. Nevertheless, it would not go beyond the invention for the body of the injection head to be made by molding and for the tube 54 to be made during said molding by using some suitable technique. Under such circumstances, the body of the injection head would be a solid piece in which the tube 54 is constituted by a recess.

What is claimed is:

1. A head for injecting liquid under pressure from a borehole to break up soil, said head being mounted at the end of a drill string, said string including liquid feed means for feeding liquid under pressure, said head comprising:

a body having an outside wall and a top end for connection to the bottom end of the drill string;

at least one injection nozzle mounted in said body, the inlet diameter of said nozzle being equal to d, said nozzle possessing an axis (x–x'); and duct-forming means for connecting the feed of liquid to the inlet of said nozzle, said duct-forming means presenting a mean line having a first end connected to the bottom end of said liquid feed means and having a second end connected to the nozzle tangentially to said axis (x–x'), said mean line being defined by at least one curved portion presenting a radius of curvature that varies continuously, the right section of said duct-forming means decreasing regularly over at least half of its length from its first end to its second end.

2. A head for injecting liquid under pressure in accordance with claim 1, in which the first end of the mean line of said duct-forming means is connected tangentially to the axis of the bottom end of the liquid feed means.

3. A head for injecting liquid under pressure in accordance with claim 1, in which the axis of the liquid feed means coincides substantially with the axis of said body of the injection head, and the mean line of the duct-forming means comprises a first curved portion extending between said first end and an intermediate point and presenting regular curvature whose concavity presents a first sign, and a second curved portion extending between said intermediate point and said second end, and presenting regular curvature whose concavity presents an opposite sign.

4. An injection head according to claim 1, in which said duct-forming means are of substantially circular right section.

5. An injection head according to claim 1, in which said duct-forming means has a right section that is oval in shape.

6. An injection head according to claim 1, having a plurality of injection nozzles and a plurality of duct-forming means, each being connected to a respective injection nozzle.

7. An injection head according to claim 1, in which said duct-forming means consists in a tube which is separate from said body of the injection head.

8. An injection head according to claim 1, in which said injection head body is made by molding, and the duct-forming means are formed during the molding.

9. A head for injecting a liquid under pressure from a borehole to break up the soil, said head being mounted at the end of a drill string, said string including liquid feed means for feeding a liquid under pressure, said head comprising:

a body having a top end for connection to the bottom end of the drill string, a bottom end, and an outside wall;

at least one injection nozzle mounted in said body, the inlet diameter of the nozzle being equal to d, and the nozzle presenting an axis (x–x');

a tool mounted at the bottom end of said body;

a feed tube for feeding said tool connected to said feed means and extending into said body; and the duct-forming means presenting a first end connected substantially tangentially to said feed tube and a second end connected to said nozzle, said duct-forming means presenting a mean line whose first end is connected to said tube and whose second end is connected to the nozzle tangentially to said axis (x–x'), said mean line being defined by at least one curved portion presenting a radius of curvature that varies continuously, the right section of such duct-forming means decreasing regularly over at least half of its length from its first end to its second end.

10. A head for injecting liquid under pressure in accordance with claim 9, in which the axis of said feed tube coincides substantially with the axis of the body of the injection head and in which the mean line of the duct-forming means comprises a curved first portion extending between said first end and an intermediate point and presenting regular curvature whose concavity presents a first sign, and a second curved portion extending between said intermediate point and said second end, presenting regular curvature whose concavity presents an opposite sign.

* * * * *